US006390100B1

(12) United States Patent
Schumacher et al.

(10) Patent No.: US 6,390,100 B1
(45) Date of Patent: May 21, 2002

(54) METHOD OF AND APPARATUS FOR MAKING CIGARETTE RODS WITH COMPOSITE FILLERS

(75) Inventors: Peter Schumacher, Hamburg; Andreas Herburg, Trittau; Manouchehr Naebian, Hamburg; Thomas Jung, Bayreuth, all of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/447,797

(22) Filed: Nov. 23, 1999

(30) Foreign Application Priority Data

Nov. 25, 1998 (DE) ..... 198 54 364

(51) Int. Cl.[7] ..... A24C 5/18; A24C 5/28

(52) U.S. Cl. ..... 131/84.4; 131/84.1; 131/84.2; 131/84.3; 131/906

(58) Field of Search ..... 131/84.1, 84.3, 131/360, 364, 84.2, 84.4, 361, 906

(56) References Cited

U.S. PATENT DOCUMENTS

| | | | | |
|---|---|---|---|---|
| 3,987,804 A | | 10/1976 | Molins et al. | |
| 4,716,913 A | * | 1/1988 | Brackmann | 131/365 |
| 4,721,119 A | | 1/1988 | Ludszeweit et al. | |
| 4,727,888 A | | 3/1988 | Luke | |
| 4,805,641 A | | 2/1989 | Radzio et al. | |
| 4,874,004 A | | 10/1989 | Borowski et al. | |
| 4,901,860 A | | 2/1990 | Wahle et al. | |
| 4,986,285 A | | 1/1991 | Radzio et al. | |
| 5,072,742 A | | 12/1991 | Heitmann | |
| 5,135,008 A | | 8/1992 | Oesterling et al. | |
| 5,188,127 A | | 2/1993 | Heitmann | |
| 5,736,864 A | | 4/1998 | Möller | |

FOREIGN PATENT DOCUMENTS

| | | |
|---|---|---|
| DE | 20 15 387 | 12/1970 |
| DE | 36 02 846 | 8/1986 |
| DE | 37 43 597 | 2/1989 |
| DE | 196 25 944 | 1/1997 |
| DE | 197 05 260 | 8/1997 |
| FR | 998.556 | 1/1952 |

* cited by examiner

*Primary Examiner*—James Derrington
*Assistant Examiner*—Dionne A. Walls
(74) *Attorney, Agent, or Firm*—Venable; Robert Kinberg

(57) ABSTRACT

A continuous rod with a composite filler having a core constituting a small-diameter cigarette rod and a tube surrounding the core and being confined within a converted web of cigarette paper has axially spaced-apart densified sections in the core as well as in the tube. When the continuous rod is converted into a series of discrete cigarettes, it is severed simultaneously across the densified sections of the core as well as across the densified sections of the tube. If the densified sections of the core are not confined within the densified sections of the tube, a trimming device of the maker of the core is adjusted to shift the locations of the thereafter formed densified sections of the core until such densified sections register with those of the tube.

28 Claims, 4 Drawing Sheets

METHOD OF AND APPARATUS FOR MAKING CIGARETTE RODS WITH COMPOSITE FILLERS

CROSS-REFERENCE TO RELATED CASES

This application claims the priority of German patent application Serial No. 198 54 364.6 filed Nov. 25, 1998. The disclosure of the German patent application, as well as that of each. US and foreign patent and patent application mentioned in the specification of the present application, is incorporated herein by reference.

BACKGROUND OF THE INVENTION

The present invention relates to methods of and to apparatus for making rod-shaped articles of the tobacco processing industry. More particularly, the invention relates to improvements in methods of and in apparatus for making rod-shaped articles (such as plain or filter cigarettes, cigars, cigarillos or the like and hereinafter referred to as cigarettes for short) of the type wherein the so-called filler (i.e., the rod-shaped body which is surrounded by a tubular wrapper of cigarette paper or the like) contains at least two different materials, e.g., two different types of shredded and/or otherwise comminuted tobacco leaves.

It is known to produce cigarettes with fillers wherein a centrally located longitudinally extending portion (hereinafter called core for short) is made of a first material and is surrounded by an elongated tubular portion (hereinafter called tube for short). The filler is draped into a continuous web of cigarette paper or other suitable wrapping material, and the resulting continuous cigarette rod it severed by a cutoff at desired intervals to yield a series or file of successive cigarettes of unit length or multiple unit length. Cigarettes of unit length constitute plain cigarettes which can be admitted into a packing machine. On the other hand, cigarettes of multiple unit length (and, in certain instances also cigarettes of unit length) are or can be admitted into a so-called tipping machine wherein the cigarettes are assembled with filter rod sections to yield filter cigarettes.

Heretofore known proposals to make rod-like fillers of the type wherein a core of a first smokable material is surrounded by a tube of a different second smokable material include the utilization of a cigarette rod maker which turns out a continuous core and advances it lengthwise along a path extending through a station wherein a second maker confines successive increments of the core in successive increments of the tube. The resulting composite filler is advanced through a mechanism which drapes a continuous web of cigarette paper around the tube, and the thus obtained continuous cigarette rod is caused to advance into the range of the aforementioned cutoff which is operated to sever the leader of the advancing cigarette rod at desired intervals to convert the rod into a file of plain cigarettes of unit length or multiple unit length.

The core can constitute an elongated empty cylindrical body or a cylindrical body which is filled with comminuted tobacco. For example, the cylindrical body can be made of a higher-quality tobacco and can be filled with tobacco of a lower quality (or vice versa).

French patent No. 998 556 discloses the making of so-called coaxial cigarettes wherein the core of the filler consists of lower-quality tobacco and is embedded in a tube consisting of or containing tobacco of a higher quality.

German patent No. 36 02 846 C2 (corresponding to U.S. Pat. No. 4,727,888) discloses the making of a composite cigarette rod wherein the core consists of a standard cigarette rod (in which a rod-like filler of tobacco is confined in a tubular envelope of cigarette paper); the core is confined in a tubular body of tobacco which, in turn, is confined in a second tubular envelope of cigarette paper or the like. The particulate material of the core and/or of the tubular body can be natural tobacco, reconstituted tobacco and/or artificial tobacco.

German patent No. 37 43 597 C1 (corresponding to U.S. Pat. No. 4,874,004) discloses a coaxial cigarette wherein the tobacco-containing (smokable) part is similar to that disclosed in German patent No. 36 02 846 C2, and which further comprises an inner filter mouthpiece aligned with one end of the core and an outer filter mouthpiece disposed at one end of the tubular tobacco-containing component and surrounding the inner mouthpiece.

German patent No. 20 15 387 C2 (corresponding to U.S. Pat. No. 3,987,804) proposes to place a cigarette rod onto a first layer of tobacco particles, to provide a second layer of tobacco particles which overlies the cigarette rod and the marginal portions of the first layer at both sides of the cigarette rod, and to thereupon drape the two layers and the cigarette rod between them into an outer envelope to form a composite cigarette rod which is ready to be severed at intervals to yield coaxial cigarettes.

A drawback of heretofore known so-called coaxial cigarettes is that they are likely to lose tobacco shreds or other forms of comminuted tobacco at their tobacco-containing ends. To the best of the inventors' knowledge and belief, the coaxial cigarettes lack the feature which is known in connection with the making of cigarettes having a simple rod-like filler of natural, artificial and/or reconstituted tobacco, namely to reinforce (such as densify) the tobacco-containing ends of the fillers and to thus prevent the escape of tobacco particles.

OBJECTS OF THE INVENTION

An object of the invention is to provide a method of making high-quality rod-shaped articles, such as plain or filter cigarettes, cigarillos, cigars or the like, wherein rod-shaped fillers consisting of two or more different materials are confined in tubular envelopes of cigarette paper or the like.

Another object of the invention is to provide a method which renders it possible to densify the ends of fillers in rod-shaped smokers' products wherein each filler consists of or contains two or more different smokable and/or other materials.

A further object of the invention is to provide a method of densifying the ends of fillers in plain or filter cigarettes in a novel and improved way.

An additional object of the invention is to provide a novel and improved mode of monitoring the density and/or other parameters of composite fillers which are utilized for the making of rod-shaped smokers' products.

Still another object of the invention is to provide a novel and improved method of preventing or at least reducing the likelihood of escape of particulate material from the ends of cigarettes, cigars, cigarillos and/or other rod-shaped articles of the tobacco processing industry of the type wherein the filler consists of or contains two or more smokable or tobacco smoke filtering materials.

A further object of the invention is to provide a novel and improved apparatus for the practice of the above outlined method.

Another object of the invention is to provide the apparatus with novel and improved means for densifying the ends of fillers in cigarettes or analogous rod-shaped smokers' products of the type wherein the fillers contain two or more different types of smokable or tobacco smoke filtering material.

An additional object of the invention is to provide an apparatus which can be readily, such as automatically, adjusted when the quality of rod-shaped smokers' products which are produced therein, departs from a desired or prescribed quality.

Still another object of the invention is to provide the above outlined apparatus with novel and improved means for generating, processing and/or otherwise utilizing signals which denote the characteristics of the ingredients of rod-shaped fillers which contain different types of smokable and/or tobacco smoke filtering materials to be confined in the wrappers of cigarettes, cigars, cigarillos and/or other rod-shaped smokers' products.

A further object of the invention is to provide the improved apparatus with novel and improved means for reducing the number of rejects, to enhance the quality of fillers of cigarettes or the like, and to reduce the likelihood of escape of particulate material at the ends of plain or filter cigarettes or analogous rod-shaped smokers' products wherein the fillers contain two or more different types of smokable and/or smoke filtering material.

SUMMARY OF THE INVENTION

One feature of the present invention resides in the provision of a method of making a series of successive elongated rod-shaped smokable articles wherein longitudinally extending central core portions are surrounded by tube portions which, in turn, are surrounded by tubular wrapper portions. The improved method comprises the steps of forming a continuous elongated core component of a first material and advancing the core component lengthwise in a predetermined direction along a predetermined path, and building a continuous tube component of a second material around successive increments of the advancing core component in at least one first portion of the path (the building step can be carried out in several successive stages) to thus provide a composite rod-shaped filler wherein the tube component surrounds the core component. At least one of the forming and building steps includes providing the respective component with alternating first and second sections respectively containing larger and smaller quantities of the respective material, and the method further comprises the steps of draping successive increments of the filler into a continuous web of wrapping material in a second portion of the path downstream of the at least one first portion, and repeatedly severing the draped filler at the first sections to thus convert the draped filler into the aforementioned series of rod-shaped smokable articles each having a first end and a second end. This ensures that at least one end of each article contains the larger quantity of the respective material. If the draped filler is severed across the first sections, each end of each article contains a densified portion of the filler. Densification takes place as a result of draping of the filler, e.g., in a mechanism similar to that utilized in cigarette rod making machines wherein a continuous rod-shaped filler of tobacco is confined in a web of cigarette paper.

The articles which are obtained in response to repeated severing of the draped filler can be of unit length (i.e., each such article can constitute a plain cigarette, cigar, cigarillo or the like) or of multiple unit length (such articles are often utilized in filter tipping machines wherein plain cigarettes or the like are joined with filter rod sections to form therewith filter cigarettes or the like. As a rule, the articles which are obtained as a result of severing of the draped filler have identical lengths.

Each of the folding and building steps can include providing the respective component with alternating first and second sections which respectively contain larger and smaller quantities of the respective material. This can result in the making of rod-shaped articles having ends containing tightly packed particles of first and second materials. Alternatively, it is possible to achieve savings in the first and/or second material by reducing the quantities of first material in the first portions of the core component and/or the quantities of second material in the first portions of the tube component. The forming and building steps of a method wherein each of the forming and building steps includes providing the respective component with alternating first and second sections can further comprise distributing at least the first sections of the core and tube components at predetermined distances from each other (as seen in the longitudinal direction of the draped filler).

Still further, the just discussed method can further comprise the steps of monitoring the positions of the first sections of at least one of the core and tube components in a third portion of the path downstream of one of the first and second path portions, and correcting the positions of the first sections in the core component and/or in the tube component when the monitored positions deviate or depart from predetermined (e.g., experimentally ascertained optimum) positions. In accordance with such method, the aforementioned correcting step can be carried out when the monitored positions deviate from the predetermined positions to a predetermined extent, i.e., an extent outside of an acceptable range.

The aforementioned monitoring and correcting steps can be carried out with equal advantage if only one of the two components is provided with alternating first and second sections.

The method can further comprise the steps of measuring the density of the draped filler, utilizing the measuring step to ascertain the length of the first sections in the predetermined direction, comparing the ascertained length of the first sections with a predetermined (standard) length, and correcting the at least one of the forming and building steps when the comparing step reveals departures of ascertained length of the first sections from the predetermined length. The correcting step can include changing the length of the first sections to the predetermined length.

Alternatively, the improved method can comprise the additional steps of measuring the density of the draped filler in a further portion of the path at a fixed distance from a stationary reference point at the path, utilizing the results of such measurements to ascertain the distances of successive first sections from the reference point and the lengths of successive first sections in the predetermined direction, and adjusting the at least one of the forming and building steps when the lengths of successive first sections depart from a preselected value. The severing step of such method is or can be carried out at the stationary reference point.

If each of the forming and building steps includes providing the respective component with alternating first and second sections respectively containing larger and smaller quantities of the respective material, the severing step can be carried out in a third portion of the path downstream of the second portion. One of the forming and building steps in such method can include providing the respective component with first sections at a fixed distance from each other (as seen in the predetermined direction), and the other of the forming and building steps can include providing the respective component with first sections at a variable distance from each other (as seen in the predetermined direction) Still further, if each of the forming and building steps includes providing the respective component with alternating first and second sections respectively containing larger and smaller quantities of the respective material, the method can further comprise the steps of monitoring the density of the core component upstream of the first portion of the path to thus ascertain the distances of successive first sections of the core component from a fixed reference point at the path, comparing the thus ascertained distance with a predetermined distance, and correcting the positions of the first sections of the core component relative to the first sections of the tube component in the predetermined direction when the ascertained distances depart from the predetermined distance.

The method can further comprise the steps of establishing an elongated reservoir in a preselected portion of the path upstream of the at least one first portion of the path, and monitoring the density of the core component at a portion of the reservoir nearest to the at least one first portion of the path.

If each of the forming and building steps includes providing the respective component with alternating first and second sections respectively containing larger and small or smaller quantities of the respective material, the method can further comprise the steps of monitoring, in a further portion of the path, the distances of successive first sections in one of the components from a fixed reference point at the path, comparing the monitored distances with a reference distance, and at least temporarily adjusting the forming or the adjusting step when the comparing step reveals a departure of the monitored distances from the fixed reference distance.

Another feature of the present invention resides in the provision of an apparatus for making a series of successive elongated rod-shaped smokable articles wherein longitudinally extending central core portions are surrounded by tube portions which, in turn, are surrounded by tubular wrapper portions. The improved apparatus comprises means for forming a continuous core component of a first material including means for advancing the core component lengthwise in a predetermined direction along a predetermined path, and means for building a continuous tube component of a second material around successive increments of the advancing core component in at least one first portion of the path to thus provide a composite rod-shaped filler wherein the core component is surrounded by and advances with the tube component. At least one of the forming and building means includes at least one densifying means for providing the respective component with alternating first and second sections respectively containing larger and smaller quantities of the respective material, and the apparatus further comprises means for draping successive increments of the filler into a continuous web of wrapping material in a second portion of the path downstream of the at least one first portion, and means for repeatedly severing the draped filler at the first sections of the core component and/or the tube component to thus convert the filler into the aforementioned series of articles each having a first end and a second end. At least one end of each article contains the larger quantity of the respective material.

The advancing means of the core forming means includes means for transporting the core component, the tube component and he draped filler at a predetermined speed, and the severing means includes means for cutting across the draped filler in the predetermined path at a frequency in synchronism with the predetermined speed so that the series of successive elongated rod-shaped smokable articles contains articles having a predetermined length, namely unit length or multiple unit length.

It is often preferred to construct the improved apparatus in such a way that each of the core forming means and the tube building means comprises at least one densifying means which is operable to provide the respective component with alternating first and second sections respectively containing larger and smaller quantities of the respective material. Such apparatus can further comprise means for synchronizing the operation of the at least one densifying means of the core forming means with the operation of the at least one densifying means of the tube building means.

As a rule, the densifying means is adjustable, and the apparatus employing one or more adjustable densifying means further comprises means for monitoring the component turned out by the (forming or building) means including an adjustable densifying means. The monitoring means is designed to generate signals in response to detection of the first sections, and such apparatus further comprises means for evaluating the signals and for initiating adjustments of the densifying means when the positions of the first sections relative to a predetermined reference point deviate from predetermined positions. The adjustments preferably involve at least partial elimination of deviation of monitored positions of the first sections in the core component and/or in the tube component from the predetermined positions.

If each of the forming and building means comprises at least one densifying means and at least one of the densifying means is adjustable, the apparatus can further comprise first and second means for respectively monitoring the core component and the tube component and for generating first and second signals in response to detection of the respective first sections. Such apparatus can further comprise means for evaluating the signals and for initiating adjustments of the at least one adjustable densifying means when the positions of detected first sections provided by the at least one adjustable densifying means depart from predetermined positions. The evaluating means is operative to effect adjustments of the first sections provided by the at least one adjustable densifying means in a sense to at least reduce departures of positions of detected first sections from the predetermined positions.

The severing means is spaced apart and can be disposed at a predetermined distance from the at least one densifying means, and the densifying means of such apparatus can comprise means for providing or turning out the first sections at a first frequency which is a function of the speed of lengthwise advancement of the core component along the predetermined path. The severing means can comprise means for cutting across the draped filler at a second frequency in synchronism with the first frequency to thus ensure that each article comprises a first section at the at least one end of such article.

If each of the forming and building means comprises at least one densifying means and if at least the at least one densifying means of the forming means is adjustable, the apparatus can further comprise first signal generating means for monitoring the core component in a third portion of the predetermined path upstream of the at least one first portion to ascertain the positions of first sections of the core component, second signal generating means for monitoring the tube component to ascertain the positions of first portions of the tube component, and means for evaluating signals from the first and second signal gene-rating means and for adjusting the at least one adjustable densifying means when the monitored positions of first sections of the core component relative to the monitored positions of first sections of the tube component depart from predetermined values.

The apparatus can further comprise a reservoir for a length of advancing core component between the forming means and the building means. Such reservoir has an intake end nearer to and a discharge end remote from the forming means, and such apparatus further comprises signal generating means for monitoring the densities of successive increments of the core component and the positions of successive first sections of the core component relative to a fixed reference point. The path for the core component in such apparatus includes a portion which is disposed between the intake and discharge ends of the reservoir and wherein the core component is free to sag under the action of gravity. The advancing means of the forming means in such apparatus is adjustable by a position monitoring device which serves to vary the speed of the core component as a function of changes of the extent of sag of the aforementioned portion of the core component in the reservoir.

The advancing means can comprise an endless foraminous belt or band conveyor, a suction chamber adjacent one side of the conveyor, and means for delivering successive increments of the core component toward the other side of the conveyor. The means for building a continuous tube component comprises means for establishing a layer of the second material at the other side of the conveyor prior to delivery of successive increments of the core component so that the delivered increments of the core component overlie the layer.

As a rule, or at least in many instances, at least one of the first and second materials is a particulate material, e.g., tobacco shreds. The at least one densifying means can comprise at least one equalizing device having means for converting an untrimmed flow of particulate material into a trimmed flow wherein the first sections alternate with the second sections as seen in the predetermined direction. Such trimming or equalizing devices are utilized extensively in cigarette rod making machines to convert a stream of tobacco particles into a rod-like filler ready to be draped into a continuous web of cigarette paper.

The novel features which are considered as characteristic of the invention are set forth in particular in the appended claims. The improved apparatus itself, however, both as to its construction and the modes of making, assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
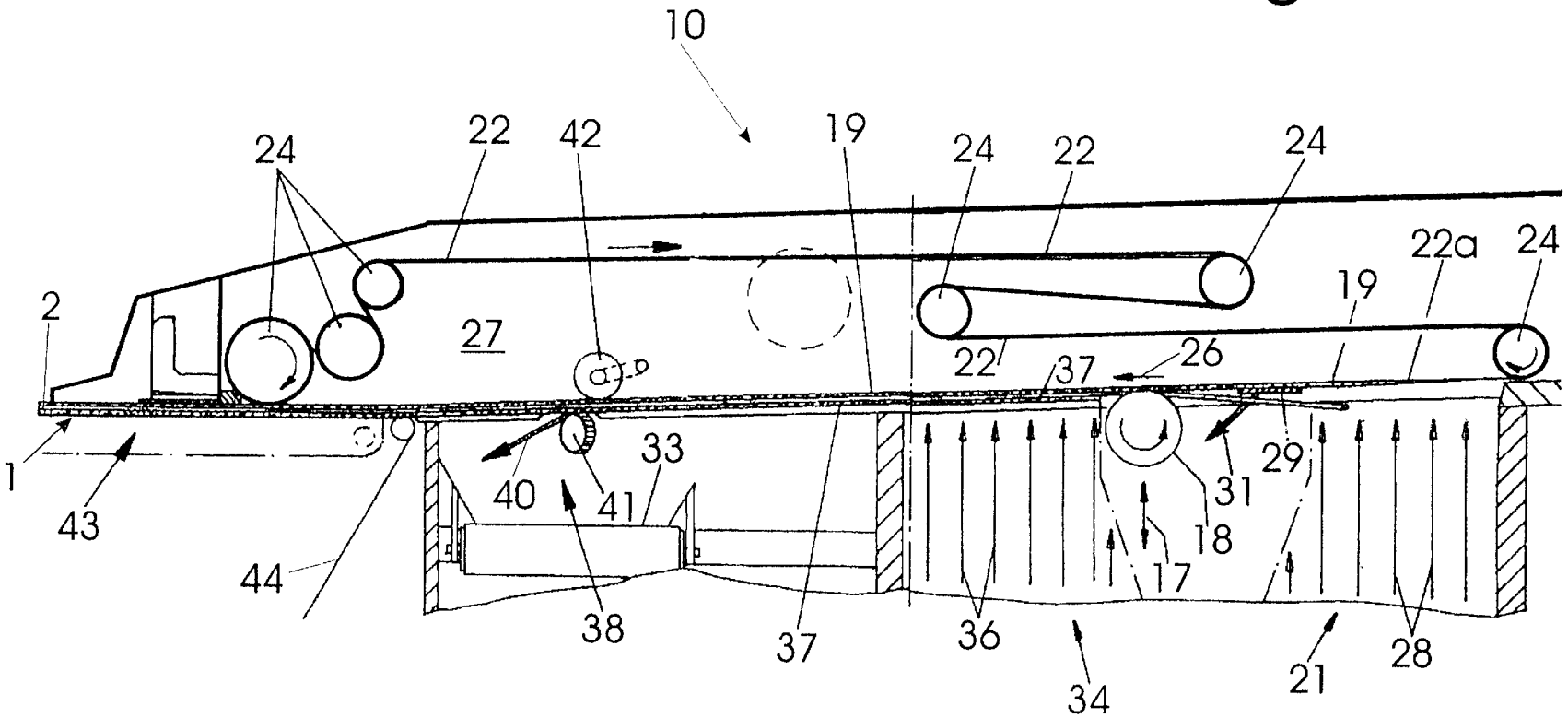
FIG. 1 is a fragmentary schematic central longitudinal vertical sectional view of an apparatus which embodies one form of the present invention.
Figure 2:
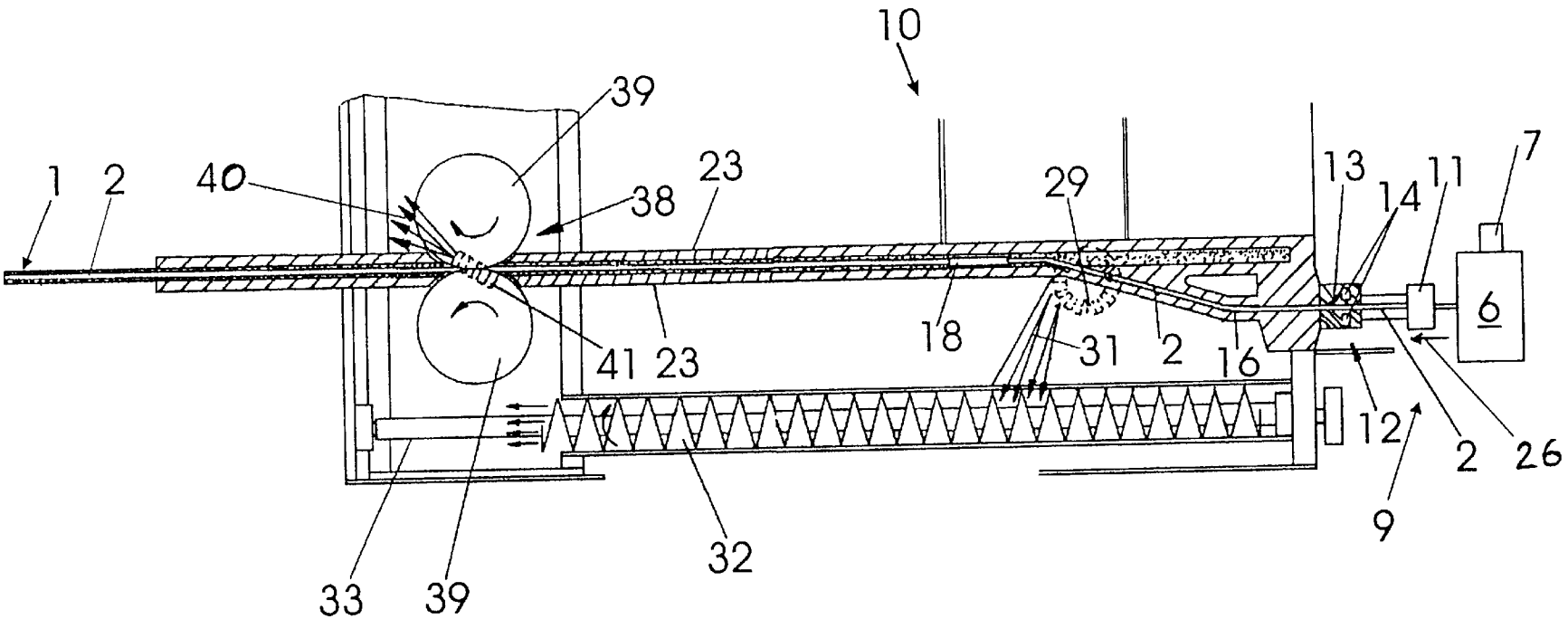
FIG. 2 is a fragmentary partly horizontal longitudinal sectional view of the apparatus of FIG. 1.

Referring first to FIGS. 1 and 2, there is shown a portion of an apparatus for making a series of successive rod-shaped articles 4 (see the left-hand portion of FIG. 3) each of which comprises a longitudinally extending central core portion (namely a portion of an elongated core 2), a tube portion (namely a portion of an elongated tube made of two layers 19, 37 of particulate material) which surrounds the core portion, and a tubular wrapper portion (namely a portion of an elongated tubular wrapper constituting a converted web 44 of cigarette paper or the like) which surrounds the tube portion. The core portion and the tube portion together constitute a rod-like filler of the respective article 4. Successive finished articles are transported to storage, to a filter tipping machine where they are provided with filter mouthpieces, or to a packing machine wherein they are assembled into groups which are confined in suitable envelopes to constitute so-called packets, e.g., hinged-lid packets or soft packets.

Successive articles 4 are obtained as a result of repeated severing of the leader of a continuous cigarette rod 1 which comprises a rod-like filler composed of the core 2 and the surrounding tube (including the converted layers 19, 37) and a continuous tubular wrapper (converted cigarette paper web 44). The severing step is performed by an adjustable cutoff 46 (shown in the left-hand portion of FIG. 3) which cuts across the cigarette rod 1 while the latter is advanced at a selected (normally variable) speed in the direction of the arrow 26.

Figure 3:
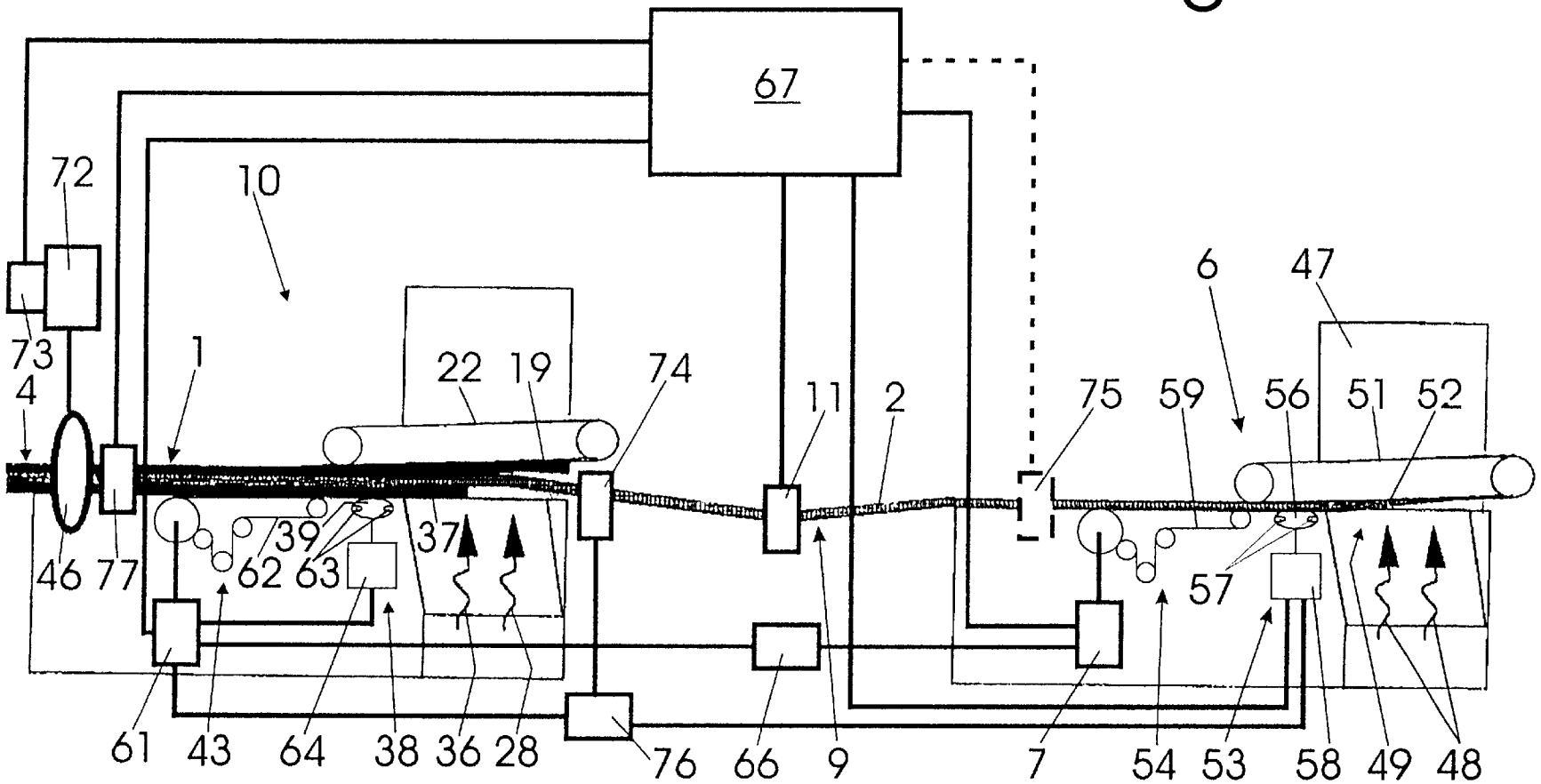
FIG. 3 is a diagrammatic side elevational view of the apparatus including the portions shown in FIGS. 1 and 2, and further showing the control and regulating systems which can alter the axial positions of densified sections of the core component and tube component relative to each other.

The means for forming the core 2 comprises a so-called maker 6 certain details of which are shown in FIG. 3. The main prime mover of the maker 6 is an adjustable electric or other suitable motor 7. For example, the core 2 can constitute a standard rod-like filler made of a (first) material (such as shredded natural, artificial or reconstituted tobacco) of the type used in standard plain cigarettes. In the illustrated embodiment, the core 2 comprises a rod-like filler of smokable material and a tubular wrapper of cigarette paper or other suitable wrapping material. For example, the rod forming means or maker 6 can constitute a cigarette rod making machine of the type known as PROTOS (distributed by the assignee of the present application). This maker is set up to turn out a continuous core (cigarette rod) 2 having a diameter considerably less than that of a standard plain cigarette;

such core or rod 2 is not severed as in a standard PROTOS machine but is simply advanced lengthwise in the direction of the arrow 26 toward a machine 10 which serves to build the cigarette rod 1, i.e., that rod which is severed at 46 to yield the series of rod-shaped articles 4.

On its way from the maker 6 to the machine or maker 10, the core 2 advances through a magazine or reservoir 9 (see also FIG. 3). The means for advancing the core 2 in the direction of the arrow 26 from the maker 6, through the reservoir 9 and into the machine 10 can constitute a mechanical, pneumatic or other suitable conveyor. FIG. 2 shows schematically a pneumatic conveyor including an array 12 of nozzles having plenum chambers 13 and suitably inclined orifices 14 which direct streams of a compressed gaseous fluid (such as air) in directions making acute angles with the direction indicated by the arrow 26. Such streams impinge upon the wrapper of the core 2 and propel it from the reservoir 9 into the machine 10.

Successive increments of the core 2 which advance beyond the pneumatic conveyor 12 enter a tubular guide 16 which directs such increments toward a further guide 18 serving to cause the core to abut the exposed underside of a relatively wide layer 19 of a smokable (second) material. The machine 10 converts the layer 19 into a portion (e.g., the upper half) of the aforementioned tube which surrounds the core 2 in the finished cigarette rod 1. The guide 18 can constitute a roller (see FIG. 1) which is driven by a motor or as a result of contact with the advancing core 2 and is oscillatable up and down as indicated by the double-headed arrow 17 shown in the right-hand portion of FIG. 1. Alternatively, the illustrated further guide 18 can be replaced by a much simpler stationary guide (not shown) which is set up, to define for the core 2 a path portion extending from the path portion defined by the pneumatic conveyor 12 toward the underside of the layer 19.

The layer 19 is built in a portion 21 of the machine 10 at the underside of the elongated lower reach or stretch 22*a* of an endless foraminous belt conveyor 22. The upper side of such lower reach 22*a* is adjacent the open underside of a stationary suction chamber 27 which attracts tobacco particles ascending (see the arrows 28 in FIG. 1) in a duct of the machine portion 21. The belt conveyor 22 is trained over pulleys 24 at least one of which is driven to advance the lower reach 22*a* in the direction of the arrow 26. The tobacco particles which rise in the aforementioned duct of the machine 10 and are attracted to the lower reach 22*a* by air flowing upwardly into the suction chamber 27 gather at the underside of the lower reach 22*a* and form the aforementioned relatively thin layer 19.

The layer 19 is preferably trimmed or equalized by a suitable trimming or equalizing device 29 (e.g., of the type employed in the aforementioned PROTOS machine) to remove the surplus 31 and propel it into the range of a screw conveyor 32 which, in turn, delivers the removed surplus into the range of a further conveyor 33 serving to return tobacco particles to the so-called distributor of the machine 10.

The machine 10 further comprises a second portion 34 which receives successive increments of the core 2 and of the equalized layer 19 and forms a second layer 37 constituting the second portion (e.g., the second half) of the composite tube surrounding the core 2 and being wrapped into the aforementioned web 44 of cigarette paper or the like. The second portion 34 of the machine 10 comprises a duct serving to supply a rising shower (see the arrows 36 in FIG. 1) of smokable (second) particulate material which underlies the core 2 and the marginal portions of the first layer 19. The underside of the layer 37 is trimmed by a further equalizing device 38 which may but need not be identical with the equalizing device 29. The illustrated equalizing device 38 comprises two cooperating driven clamping rollers 39 which engage the underside of the layer 37 at a certain level beneath the adjacent portion of the lower reach 22*a*, and a rotary brush or paddle wheel 41 which sweeps away the surplus 40, e.g., into a duct which directs the surplus onto the aforementioned takeoff conveyor 33.

FIG. 1 shows a substantially vertically adjustable roller 42 (e.g., an idler roller) which is movable up and down by a pivotable lever or the like to move the adjacent portions of the layers 19, 37 and the-core 2 between them nearer to or further away from the clamping rollers 37 to thus select the quantity of tobacco particles being removed by the rotary member 41 of the equalizing device 38. Thus, the roller 42 can determine the quantity of tobacco particles in the tube surrounding the core 2 in the finished cigarette rod 1. Otherwise stated, the selected level of the adjusting roller 42 determines the exact weight of the articles 4 by relecting the quantity of particulate material in the layer 37, i.e., in the future tube of the rod 1.

The partially finished composite filler including the core, 2 and the layers 19, 37 thereupon enters a standard wrapping mechanism 43 wherein successive increments of the running cigarette paper web 44 are draped around successive increments of the developing composite filler (including the layers 19, 37) in the thus obtained cigarette rod 1. The wrapping mechanism 43 can be of the type employed in the aforementioned PROTOS cigarette rod making machine, and such mechanism discharges successive increments of the rod 1 into the range of the cutoff 46. Draping of the web 44 around the core 2 and the layers 19, 37 results in conversion of the trimmed layers 19, 37 into an elongated composite tube which surrounds the core 2 and is surrounded by the tubular wrapper (former cigarette paper web 44).

FIG. 3 shows (on a smaller scale) numerous parts of the apparatus including the maker 6 and the machine 10 as well as the parts which synchronize the operation of the machine 10 with that of the maker 6 and which further ensure that at least one end portion of each cigarette 4 includes a relatively short first section containing a relatively large quantity of smokable material, and that each cigarette 4 further includes a relatively long second section containing a relatively small quantity of material per unit length. As will be described with reference to FIGS. 4, 5 and 6, it is often preferred to ensure that each of the two end portions or sections of the filler in a cigarette 4 contains larger quantities of smokable material, and that the central portion (i.e., portion of the core 2) contains smaller quantities of smokable material per unit length.

FIG. 3 further shows certain additional constituents of the maker 6, i.e., of the machine adapted to make the core 2 and preferably constituting or resembling the aforementioned PROTOS machine. The character 47 denotes a distributor or hopper having a magazine for confinement of a supply of particulate material to form the rod-like filler of the draped cigarette rod constituting the core 2. The distributor 47 further comprises suitable means for loosening the particulate material and for propelling the thus loosened material in the direction indicated by the arrows 48 into a stream forming zone 49, namely against the underside of the lower reach of an endless foraminous conveyor 51. The upper side of the lower reach of the foraminous conveyor 51 is adjacent the open underside of a suction chamber which causes the loosened particles ascending in directions indicated by the arrows 48 to gather at the underside of the lower reach of the conveyor 51 into a relatively thin growing tobacco stream 52. The underside of the fully grown stream 52 is trimmed by an equalizing device 53 which removes the surplus (if any) , and the thus obtained equalized stream 52 advances into the range of a wrapping mechanism 54 which is or which can be identical with or analogous to the aforementioned wrapping mechanism 43. The mechanism 54 confines the trimmed stream 52 in a continuous web of cigarette paper or the like (the web is not shown in FIG. 3) to form with the confined stream the aforementioned elongated core 2 advancing in the direction of the arrow 26, i.e., toward and into the reservoir 9.

The equalizing device 53 of the maker 6 comprises two rotary clamping members 56 in the form of discs having pockets 57 for tobacco particles forming part of the surplus but not removed by the (non-illustrated) paddle wheel or brush (corresponding to the member 41 shown in FIG. 2) so that the trimmed stream 52 contains longitudinally spaced-apart (first) sections 68 (see FIGS. 4 to 6) containing larger quantities of the first material and elongated (second) sections which alternate with the sections 68 and contain smaller (second) quantities of first material per unit length of the filler of the core 2. The clamping discs 56 are driven by a discrete adjustable motor 58.

The wrapping mechanism 54 comprises an endless belt conveyor 59 (known as garniture) which drapes a cigarette paper web around the trimmed tobacco stream 52 to thus complete the making of the core 2. At least one pulley for the garniture 59 is driven by the adjustable motor 7 of the maker 6.

FIG. 3 further shows the endless belt conveyor or garniture 62 of the wrapping mechanism 43 which converts the cigarette paper web 44 into the tubular wrapper of the cigarette rod 1. One pulley for the garniture 62 is driven by the motor 61 of the machine 10 or by a discrete prime mover. The clamping members 39 of the trimming or equalizing device 38 are provided with pockets 63 which ensure that certain (first) sections 69 (see FIGS. 4, 5 and 6) contain more tobacco (second material) than the other (second) sections between successive first sections 69. The clamping members 39 (of which only one can be seen in FIG. 3) are driven by a discrete adjustable electric motor 64 or another suitable adjustable prime mover.

The adjustable motors 7 and 61 are connected to each other by a control circuit 66 in such a way that the motor 61 acts as a master an the motor 7 serves as a slave. This ensures that the operational speed of the machine 10 is always properly related to operating speed of the maker 6. It has been ascertained that, in spite of such relationship between the speed of the core 2 (i.e., of the product turned out by the maker 6) and the speed of the cigarette rod 1 (i.e., the product turned out by the machine 10), the actual speed of the core 2 in the direction of the arrow 26 can depart from the actual speed of the cigarette rod 1 under certain circumstances which are likely to arise when the improved apparatus is in use. This could result, for example, in the making of an unsatisfactory rod 1 or in tearing of the core 2 and/or rod 1.

The aforementioned reservoir 9 constitutes one means which can compensate for eventual departures of the speed of the core 2 from that of the rod 1. The placing of the reservoir 9 into the path for advancement of successive increments of the core 2 toward and into the machine 1l ensures or renders it possible to ensure that the core 2 will not tear ahead of the locus of contact with the layer 19 and thereupon with the layer 37 if the reservoir contains a certain supply of core material. Undesirable differences between the speeds of the core 2 and the layers 19, 37 are likely to develop due to slippage and/or for certain other reasons.

The extent of sag of the core 2 in the reservoir 9 is determined by a monitoring device 11 which transmits appropriate signals to a control unit 67 which, in turn, regulates the speed of the motor 7 for the maker 6. Thus, the monitoring device 11 cooperates with the control unit 67 to regulate the speed of successive increments of the core 2 issuing from the maker 6 independently of or in addition to the signals- transmitted by the control unit 66 which couples the master 61 with the slave 7. If the sag of the core 2 (due to gravity) in the reservoir 9 increases, the signals from the monitoring device 11 induce the control unit 67 to reduce the speed of the maker 6, i.e., to reduce the speed of the core 2 which advances from the intake end toward and beyond the outlet end of the reservoir. Inversely, .if the sag -of the core 2 in the reservoir 9 is reduced to a certain extent, the signal from the monitoring device 11 to the control unit 67 causes the latter to increase the speed of the motor 7, i.e., of the maker 6.

The exact construction of the monitoring device 11 forms no part of the present invention. For example, the device 11 can comprise a so-called dancer roll which floats upon the core 2 in the reservoir 9 and a sensor which generates signals denoting the level of such roll. The floating roll can be mechanically coupled to one or more low-inertia (low mass) actuators which, in turn, controls or control one or more initiators serving to transmit to the control unit 67 signals denoting the ascertained level of the floating roll. However, it is equally possible to employ one or more contact-free (such as photoelectronic) detectors which constitute or form part of the monitoring device 11 and generate and transmit signals indicating the extent of sag of the core 2 in the reservoir 9. Such contact-free detector[]s) can indirectly monitor the level of the floating roll or directly the level of the core 2 at a selected location in the reservoir 9.

Figure 4:
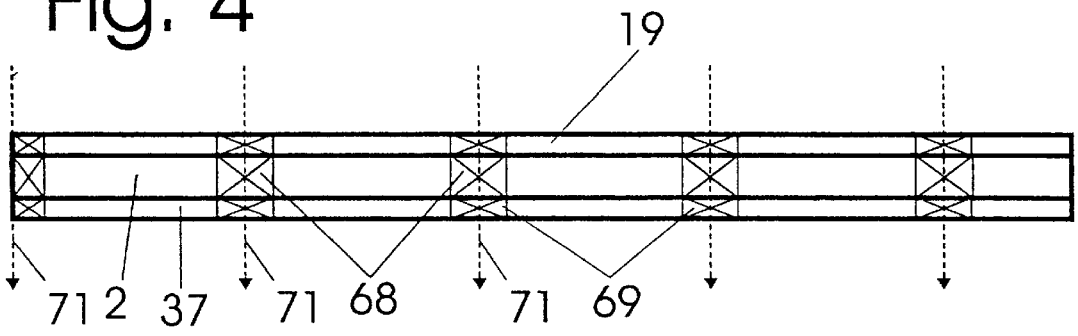
FIG. 4 is a fragmentary schematic central longitudinal sectional view of a cigarette rod wherein the densified sections of the core component are in optimum axial alignment with the densified sections of the tube component.

FIG. 4 illustrates an optimum or ideal situation when the first portions 68 of the core 2 are in exact register with (i.e., are surrounded by) the first portions 69 of the tube including the confined layers 19, 37, However, it is equally possible to replace one of the trimming devices 53, 38 with a standard trimming device (without specially configurated clamping members 56 or 39) so that the densification of the end portions of the composite fillers of successive articles is less pronounced. Thus the density of the core 2 can be constant if the equalizing device 53 is replaced with one which simply removes the surplus but does not form the (first) sections 68 containing more tobacco than the (second) sections between such first sections. Alternatively, the density of the composite tube is constant if the equalizing device 38 is replaced with a standard device which removes only such surplus (40) that is required to make a tube devoid of denser first sections 69.

If the cigarette rod 1 of FIG. 4 is severed midway across the properly aligned first sections 68 and 69 (the cuts made by the severing means 46 are indicated by broken lines., as at 71), each of the thus obtained articles (cigarettes) 4 comprises a composite filler including an elongated (second) section of lower density between two rather short (first) sections at the end portions of the cigarette. Each such first section includes one-half of a section 68 and one-half of the surrounding section 69. Cigarettes with densely packed ends are preferred by smokers because they are less likely to lose tobacco particles during withdrawal from a packet and/or during manipulation preparatory to and during lighting and/or (in the case of plain cigarettes) into the mouth of the smoker.

Figure 5:
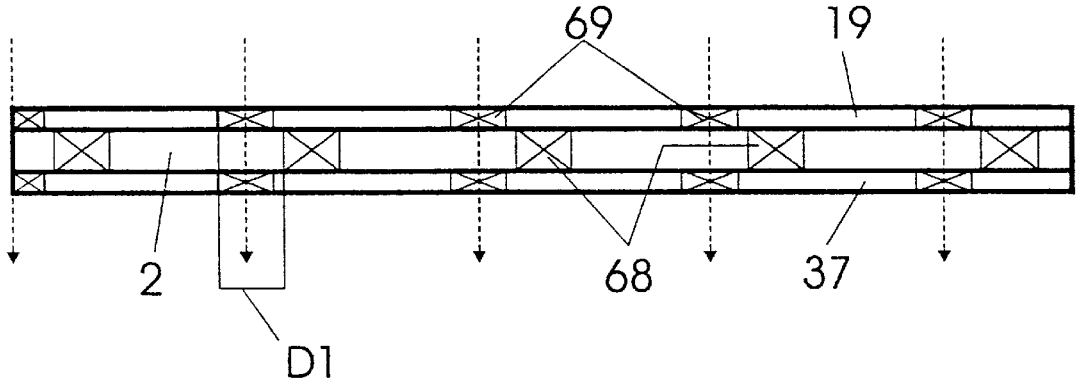
FIG. 5 illustrates a portion of a modified cigarette rod wherein the reinforced or densified sections of the core component are located upstream of the adjoining reinforced or densified sections of the tube component.

FIG. 5 illustrates a portion of a cigarette rod wherein the first sections 68 of the core 2 are axially offset relative to the first sections 69 of the composite tube including the deformed layers 19, 37. Thus, in the absence of the possibility of a remedial undertaking, the provision of a more complex equalizing device 53 (with clamping members 56 having pockets 57) would be in vain because, if the cuts 71 are made across the first sections 69 (as actually shown in FIG. 5), the densified first sections 68 are remote from the end portions of the thus obtained cigarettes. The character D1 denotes the extent of axial misalignment between the first sections 68 and the adjacent first sections 69.

Figure 6:
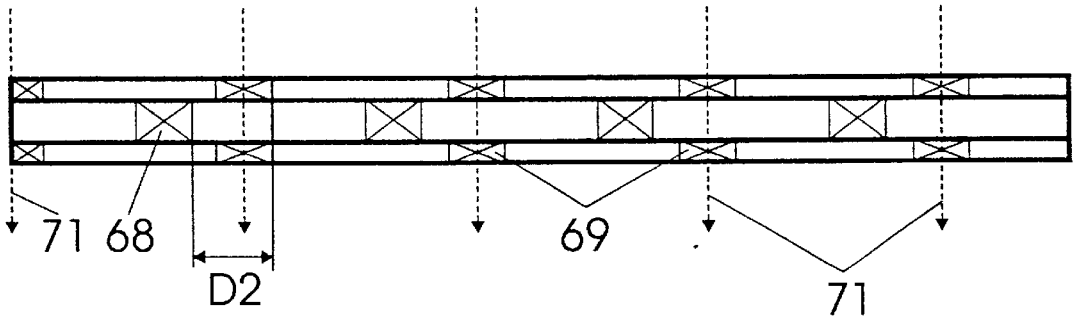
FIG. 6 shows the structure of FIG. 4 but with the densified sections of the core component located well up-stream of the adjacent densified sections of the tube component.

In FIG. 5, the first sections 68 lag behind the first sections 69. FIG. 6 shows a portion of a defective (not ideal) cigarette rod wherein the first sections, 69 of the composite tube lag behind the adjacent first sections 68 of the core 2 by distances D2. Again, the cuts 71 are made across the annular first sections 69 so that, for all practical purposes, the making of the first sections 68 was in vain.

Referring again to FIG. 3 there is further shown an arrangement which renders it possible to properly adjust the apparatus so that, once a defective cigarette rod 1 (such as the cigarette rod shown in FIG. 5 or in FIG. 6) is detected, the apparatus can automatically carry out adjustments which are necessary to proceed with the making of cigarette rods identical with or more closely resembling the "ideal" cigarette rod of FIG. 4.

The cutoff 46 is driven by a motor 72. This motor can constitute a main prime mover of the entire apparatus or a prime mover which drives only the mobile parts of the cutoff 46 (e.g., a knife which is moved back and forth in and counter to the direction indicated by the arrow 26 and is further caused to cut across the web during movement in the direction of the arrow 26). A discrete motor 72 can be directly coupled to the main prime mover of the apparatus. Each cigarette 4 can be of unit length or multiple unit length. As already mentioned hereinbefore, cigarettes of unit length can constitute the ultimate products (plain cigarettes) which are ready to be fed to a packing machine, and cigarettes of multiple unit length can be fed to a tipping machine which is designed to turn out filter cigarettes.

The actual timing of repeated severing of the cigarette rod 1 is monitored by an initiator 73 which transmits appropriate signals to the control circuit 67 for processing into information which is indicative of the extent of adjustment in order to depart from the making of a cigarette rod corresponding to that of FIGS. 5 or 6 (or another defective cigarette rod) and to again turn out an ideal or practically ideal cigarette rod of the type shown in FIG. 4. The arrangement is such that the control circuit 67 can alter the axial positions of successive first sections 48, i.e., influence the axial positions of the first sections 68 while the positions of the first sections 69 can remain unchanged.

The control circuit 67 couples the motor 72 for the cutoff 46 with the motor 61 for the garniture 62 of the wrapping mechanism 43. The garniture 62 determines the speed of forward movement of the cigarette rod 1 in the direction of the arrow 26. The speed of the motor 64 for the clamping discs 39 of the equalizing device 38 is directly related to the speed of the garniture 62 (see the lower left-hand portion of FIG. 3). Thus, the rate at which the knife of the cutoff 46 severs the cigarette rod 1 is accurately synchronized with the speed of the garniture 62 as well as with the speed of the equalizing device 38 (i.e., with the making of the first sections 69). Such synchronization ensures that the making of first sections 69 in the tube including the deformed layers 19, 37 will be carried out in a manner to guarantee that the cuts 71 will be made in a manner as shown in FIG. 4, i.e., at least substantially midway across the annular first sections 69. The motor 7 for the maker 6 is connected with (and is a slave of) the motor 61 of the machine 10; in addition, the motor 61 is connected with and controls the motor 58 of the trimming device 53 by way of a synchronizing unit 76. This ensures that the equalizing device 53 operates in synchronism with the wrapping mechanism 43, i.e., that the rotational speed of the clamping discs 56 is properly related to the forward speed (see the garniture 62) of the cigarette rod 1. In addition, the motor 58 can be adjusted in response to signals from the control circuit 67, and such adjustment is independent of the operating speed (see the motor 7) of the maker 6 of the core 2.

It is reasonably or highly likely that the misalignment of the first sections 68 and 69 will take place immediately upon starting of the maker 6 and the machine 10. In order to ascertain the positions of first sections 68 of the core 2, the apparatus which is shown in FIG. 3 further comprises a density measuring device 74 which is located at the outlet end of the reservoir 9, i.e., at the locus of entry of successive increments of the core 2 into the machine 10. The measuring device 74 can be designed to transmit at least one beam of nuclear, optical or infrared radiation (or other suitable radiation) across the advancing core 2, and the difference between the characteristics of the radiation entering and radiation issuing from the advancing core 2 is processed to ascertain the density of the successively monitored increments of the core. It is also possible to resort to a capacitive density measuring device 74 or to a device which operates with microwaves, e.g., a density measuring device of the type described and shown in the published German patent application Serial No. 196 25 944 A1 and in the corresponding U.S. Pat. No. 5,736,864, or in the published German patent application Serial No. 197 05 260 A1 (all owned by the assignee of the present application).

The placing of the density monitoring device 74 downstream of the reservoir 9 (wherein the core 2 is permitted to sag) and at a fixed distance from a fixed reference point (such as the locus of severing the cigarette rod 1 by the cutoff 46) is desirable and advantageous because the length of the core 2 between the device 74 and the cutoff 46 remains unchanged. The reason is that one can compare the ascertained (monitored) locations of the first sections 68 with the desired or required locations, and such comparison can be carried out with a sufficiently high degree of accuracy. This permits for considerable simplification of the evaluation of signals furnished by the density monitoring device 74. The latter transmits signals to the aforementioned synchronizing unit 76 between the motor 61 for the machine 10 and the motor 58 of the equalizing device 53. The unit 76 processes the signals from the density monitoring device 74 and compares such signals with those (furnished by the motor 61) denoting the desired or optimum positions of the first sections 68 relative to the second sections 69. The comparison signals furnished by the motor 61 indicate the required positions of the first sections 68, namely those positions which are necessary in order to guarantee the arrival of successive first sections 68 at the severing station (cutoff 46) for severing the sections 68 in a manner as shown in FIG. 4.

The synchronizing unit 76: need not constitute a discrete circuit; for example, this synchronizing unit 76 can be integrated into the control unit 67.

In the event that the quality of the cigarette rod 1 is unsatisfactory (e.g., that the first sections 68 of the core 2 are axially offset relative to the first sections 69 of the tube in a manner as shown in FIG. 5 or 6), the signals 56 from the synchronizing unit 76 to the motor 58 effect an acceleration or deceleration of the clamping discs 56 forming part of the equalizing device 53, and such adjustment continues until the density monitoring device 74 indicates that the detected positions of the first, sections 68 match the positions which are required to ensure accurate alignment or registry with the first sections 69.

As indicated in FIG. 3 by broken lines at 75, the density measuring device 74 can be transferred to a location immediately or closely downstream of the maker 6, i.e., upstream of the reservoir 9. In such apparatus, the control circuit 67 must be equipped with additional means for ascertaining the deviations of the positions of successive first sections 68 from optimum or ideal positions by taking into consideration the extent of sag (see the position monitoring device 11) of the core 2 in the reservoir 9. The extent of sag is then considered in determining the extent of adjustment of the rotational speed of the clamping discs 56 of the equalizing device 53 in order to compensate for departures (if any) of the axial positions of the first sections 68 from ideal positions (see FIG. 4) relative to the first sections 69.

The synchronizing unit 76 preferably forms part of the control unit 67 (most preferably an integral part) and is put to use to increase or reduce the speed of the clamping discs 56 of the equalizing device 53, depending on the extent of departure of the positions of first sections 68 from optimum positions relative to the adjacent first sections 69.

A further possibility of synchronizing the making of the first sections (by the equalizing device 53) with the making of the first sections 69 (by the equalizing device 38) resides in that one ascertains the locations and/or the dimensions of combined first sections each of which includes a first section 68 and a first section 69 (e.g., of ascertaining the combined axial length of a composite or combined first section including a section 68 and the adjacent section 69). To this end, one can resort to a density monitoring device 77 which is normally employed anyway and which is designed to furnish signals denoting the axial dimensions of a combined reinforcing section including a first section 68 and the adjacent section 69. The output of the density measuring or monitoring device 77 transmits appropriate signals to the control unit 67. The desired length of a composite first section including a first section .68 and the adjacent section 69 is determined, at least in part, by the dimensions of the tobacco-receiving pockets 57 and 63 in the respective clamping discs 56 and 39. For example, if the axial length of the first sections 68 matches that of the first sections 69, and if sections 68 assume ideal or optimum axial positions relative to the sections 69 (see FIG. 4), the axial length of a composite first section matches that of the first section 68 or that of the first section 69. Thus, if the density monitoring device 77 detects a certain number of successive composite first sections which are longer than a first section 68 or a first section 69, this is indicative of unsatisfactory synchronization of the rotational speed of the clamping discs 39 with that of the clamping discs 56. The control unit 67 processes the corresponding signals from the monitoring device 77 by changing the rotational speed of the discs 56 for a shorter or longer interval of time until the signals from the monitoring device 77 indicate that the overall axial length of a composite first section (68+69) matches or adequately approximates that of the first section 68 or 69.

It is clear that the same results can be obtained if the monitoring of the axial length of the first sections 68 and or 69 is replaced with the monitoring of the axial lengths of the second sections between successive first sections 68 and/or of the axial lengths of the second sections between successive first sections 69. The determined axial lengths of the second sections between the first sections 68 and/or between the first sections 69 are compared with predetermined reference lengths. Such reference lengths are determined by the rate at which the cutoff 46 severs the cigarette rod 1 to obtain the series of rod-shaped articles 4. If the axial distances between successive first portions 68 or 69 are too small or too large, this is indicative of unsatisfactory synchronization of operation of the equalizing device 53 with that of the equalizing device 38. The corresponding signals from the density measuring device 77 and/or from one or more other measuring devices are transmitted to the control unit 67 which initiates an adjustment of rotational speed of the clamping discs 56 in the aforedescribed manner, i.e., via the corresponding output of the control unit 67 and the variable-speed motor 58 for the clamping discs 56.

The discrete articles 4 which are obtained at the station accommodating the cutoff 46 are transferred onto a further conveyor (not shown) which advances successive articles 4 past one or more testing devices which detect the articles 4 having no densified end portions or having defective (such as too long) densified end portions, and the defective articles 4 are segregated from satisfactory articles (e.g., pneumatically) in a manner well known from the art of testing cigarettes.

When the improved apparatus is set in motion, the density measuring or monitoring device 74 ascertains the presence and the axial positions of the first sections 68 forming part of the core 2. Detection of such first sections 68 results in abrupt generation of one or more signals which are transmitted to the synchronizing unit 76 and denote the actual axial positions of the first sections 68. If the first sections 68 are located behind (upstream of) the first sections 69 as seen in FIG. 5, the rotational speed of the discs 56 in the equalizing device 53 is repeatedly increased for short intervals of time until the axial position of each first section 68 is such that the section 68 is fully surrounded by the adjacent first section 69 (see FIG. 4). On the other hand, if the first sections 68 are located downstream (ahead) of the first sections 69 (see FIG. 6), the rotational speed of the discs 56 is repeatedly reduced for short intervals of time so that the first sections 69 can catch up and assume axial positions corresponding to those shown in FIG. 4, i.e., positions of exact axial alignment with the adjacent first sections 68.

The aforementioned testing device which monitors the densities of successive discrete rod-shaped articles 4 can be installed in or upstream of a filter tipping machine (not shown) if the articles 4 are to be converted into filter cigarettes. Such testing device initiates the segregation of unsatisfactory articles 4 (see FIGS. 5 and 6) from satisfactory articles 4.

It has been found that the improved method and apparatus render it possible to rapidly and accurately eliminate all departures of first sections 68 from optimum axial positions relative to those of the neighboring first sections 69. This is accomplished by repeatedly altering the operation of one of the equalizing devices 38, 53 relative to the other equalizing device.

As already mentioned before, it is often sufficient to equip the apparatus with means for providing the core 2 with axially spaced-apart first sections 68 or with means for providing the tube (including the converted or processed layers 19, 37) with first sections 69. The apparatus of FIGS. 1–3 (such apparatus is provided with means for making first sections 68 as well as first sections 69) is preferred at this time because it can even more reliably ensure that both end portions of each article 4 will be densified as long as the first sections 68 are surrounded by the adjacent first sections 69 and as long as the cutoff 46 severs the cigarette rod 1 midway across the interfitted first sections 68, 69.

The axial length of the first sections 68 may but need not match the axial length of the first sections 69. It is presently preferred to provide the core 2 with first sections 68 having an axial length matching that of the first sections 69 because this simplifies the monitoring of the cigarette rod 1 at 77 and guarantees that the density of each composite first section 68+69 is constant from end to end. This, in turn, ensures that the density of the filler at one end of each cigarette 4 matches the density of the filler at the other end of the cigarette as well as that the densities of the end portions of fillers are uniform in each of a short or long series of successive cigarettes.

An advantage of that feature of the improved method and apparatus which renders it possible to achieve accurate synchronization or registry of the first sections 68 with the second sections 69 even though the axial positions of the sections 69 need, not be regulated is that the synchronizing system of the improved apparatus is surprisingly simple. Thus, and since the axial distances of successively formed first sections from the cutoff 46 are fixed, it suffices to merely monitor the positions of successively formed first sections 68 (relative to a fixed point, such as that established by the cutoff 46, or relative to the locus of making the first sections 69) and to carry out the necessary adjustments upon detection that the axial positions of the first sections 68 depart from those which are required in order to arrive at or to approach the "ideal" or optimum registry shown in FIG. 4.

To the best of applicants' knowledge and belief, none of presently known apparatus for making cigarette rods or the like with composite cores embody means for ensuring that the end portions of discrete rod-shaped articles (such as plain cigarettes) which are obtained as a result of repeated severing of the leader of the axially advancing cigarette rod exhibit densified end portions.

Commonly owned U.S. Pat. No. 5,188,127 discloses a distributor adapted to be used as a distributor (47) in the maker 6 of the apparatus embodying the present invention.

A wrapping mechanism which can be utilized (at 43) in the machine 10 of the improved apparatus is disclosed in commonly owned U.S. Pat. No. 4,721,119.

A signal generating density measuring device of the type adapted to be utilized (e.g., at 74 or 75 and/or at 77) in the apparatus of the present invention is disclosed in commonly owned U.S. Pat. No. 4,986,285.

A device for testing discrete rod shaped articles for the presence or absence of one or more defects and for effecting segregation of defective articles from satisfactory articles is disclosed in commonly owned U.S. Pat. No. 4,901,860; such device can be utilized to test successive cigarettes 4 turned out by the apparatus of the present invention.

A filter tipping machine which can be utilized to provide the cigarettes 4 (of unit or multiple unit length) with filter mouthpieces is disclosed in commonly owned U.S. Pat. No. 5,135,008.

Another density measuring device is disclosed in commonly owned U.S. Pat. No. 4,805,641.

A machine which can be utilized as the maker 6 in the apparatus of the present invention is disclosed in commonly owned U.S. Pat. No. 5,072,742. The maker of this patent can be equipped with an equalizing device (53) of the type shown in FIG. 3 of the present application. Such trimming and equalizing devices are disclosed in numerous US and foreign patents owned by the assignee of the present application.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making cigarette rods or the like with composite fillers and, therefore, such adaptations should and are intended to be comprehended within the meaning and range of equivalence of the appended claims.

What is claimed is:

1. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, each of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material, wherein said forming and building steps further comprise distributing at least the first sections of the core and tube components at predetermined distances from each other as seen in the longitudinal direction of the draped filler; and monitoring the positions of the first sections of at least one of the core and tube components in a third portion of said path downstream of one of said first and second portions and correcting the positions of the first sections in the at least one of the core and tube components when the monitored positions deviate from predetermined positions.

2. The method of claim 1, wherein said correcting step is carried out when the monitored positions deviate from the predetermined positions to a predetermined extent.

3. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, at least one of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material; and monitoring the positions of the first sections in a third portion of said path downstream of one of said first and second portions, and correcting the positions of the first sections when the monitored positions deviate from predetermined positions.

4. The method of claim 3, wherein said severing step includes subdividing the draped filler into articles having at least substantially identical lengths.

5. The method of claim 4, wherein each article of the subdivided draped filler is of unit length.

6. The method of claim 4, wherein each article of the subdivided draped filler is of multiple unit length.

7. The method of claim 3, wherein said correcting step is carried out when the monitored positions deviate from the predetermined positions to a predetermined extent.

8. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, at least one of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material; and measuring the density of the draped filler, utilizing said measuring step to ascertain the length of the first sections in said predetermined direction, comparing the ascertained length of the first sections with a predetermined length, and correcting said at least one of said forming and building steps when the comparing step reveals departures of ascertained length of said -first sections from said predetermined length.

9. The method of claim 8, wherein said correcting step includes changing the length of said first sections to said predetermined length.

10. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, at least one of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material;

measuring the density of the draped filler in a further portion of said path at a fixed distance from a stationary reference point at said path, utilizing the results of the measurements to ascertain the distances of successive first sections from said reference point and the lengths of successive first sections in said direction, and adjusting said at least one of said forming and building steps when the lengths of successive first sections depart from a preselected value.

11. The method of claim 10, wherein said severing step is carried out at said stationary reference point.

12. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, each of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material, said severing step being carried out in a third portion of said path downstream of said second portion, one of said forming and building steps including providing the respective component with first sections at a fixed distance from each other in said direction and the other of said forming and building steps including providing the respective component with first sections at a variable distance from each other in said direction.

13. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, each of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material; and monitoring the density of the core component upstream of said first portion of said path to thus ascertain the distances of successive first sections of the core component from a fixed reference point at said path, comparing the thus ascertained distances with a predetermined distance, and correcting the positions of the first sections of said core component relative to the first sections of said tube component in said direction when said ascertained distances depart from said predetermined distance.

14. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, at least one of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material; and establishing an elongated reservoir in a preselected portion of said path upstream of said at least one first portion of said path, and monitoring the density of the core component at a portion of said reservoir nearest to said at least one first portion of said path.

15. A method of making a series of successive elongated rod-shaped smokable articles wherein longitudinally extending central core portions are surrounded by tube portions which, in turn, are surrounded by tubular wrapper portions, comprising the steps of:

forming a continuous elongated core component of a first material and advancing the core component in a predetermined direction along a predetermined path;

building a continuous tube component of a second material around successive increments of the advancing core component in at least one first portion of said path to thus provide a composite rod-shaped filler, each of said forming and building steps including providing the respective component with alternating first and second sections respectively containing larger and smaller quantities of the respective material;

draping successive increments of the filler into a continuous web of wrapping material in a second portion of said path downstream of said at least one first portion;

repeatedly severing the draped filler at said first sections to thus convert the draped filler into said series of articles each having a first end and a second end, at least one end of each article containing said larger quantity of the respective material; and monitoring, in a further portion of said path, the distances of successive first sections in one of said components from a fixed reference point at said path,.comparing the monitored distances with a reference distance, and at least temporarily adjusting the respective one of said forming and building steps when the comparing step reveals a departure of the monitored distances from said fixed reference distance.

16. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, each of said forming and building means comprising at least one densifying means for providing the respective component with alternating first and second sections respectively containing larger and smaller quantities of the respective material;

means for draping successive increments of the filler into a web of wrapping material in a second portion of said path downstream of said at least one first portion;

means for repeatedly severing the draped filler at said first sections to thus convert the draped filler into said series of articles each having a first end and a second end and at least one end of each article containing said larger quantity of the respective material; and means for synchronizing the operation of said at least one densifying means of said forming means with the operation of said at least one densifying means of said building means.

17. The apparatus of claim 16, wherein said advancing means includes means for transporting said components and said draped filler at a predetermined speed and said severing means includes means for cutting across the draped filler in said path at a frequency in synchronism with said speed so that said series contains articles having a predetermined length including one of (a) a unit length and (b) a multiple unit length.

18. The apparatus of claim 16, wherein said advancing means comprises an endless foraminous belt conveyor, a suction chamber adjacent one side of said conveyor and means for delivering successive increments of the core component toward the other side of said conveyor, said means for building comprising means for establishing a layer of said second material at the other side of said conveyor prior to delivery of said successive increments of the core component so that the delivered increments overlie said layer.

19. The apparatus of claim 16, wherein at least one of said first and second materials is a particulate material and said at least one densifying means comprises at least one equalizing device having means for converting an untrimmed flow of particulate material into a trimmed flow wherein said first sections alternate with said second sections as seen in said predetermined direction.

20. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, at least one of said forming and building means including at least one adjustable densifying means for providing the respective component with alternating first and second sections respectively containing larger and smaller quantities of the respective material;

means for draping successive increments of the filler into a web of wrapping material in a second portion of said path downstream of said at least one first portion;

means for repeatedly severing the draped filler at said first sections to thus convert the draped filler into said series of articles each having a first end and a second end and at least one end of each article containing said larger quantity of the respective material;

means for monitoring the particular component furnished by said at least one of said forming and building means and for generating signals in response to detection of said first sections, and means for evaluating said signals and for initiating adjustments of said at least one densifying means when the positions of said first sections relative to a predetermined reference point deviate from predetermined positions.

21. The apparatus of claim 20, wherein said adjustments include at least partial elimination of deviation of monitored positions of said first sections from said predetermined positions.

22. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, at least one of said forming and building means comprising at least one adjustable densifying means for providing the respective component with alternating first and second sections respectively containing larger and smaller quantities of the respective material;

means for draping successive increments of the filler into a web of wrapping material in a second portion of said path downstream of said at least one first portion;

means for repeatedly severing the draped filler at said first sections to thus convert the draped filler into said series of articles each having a first end and a second end and at least one end of each article containing said larger quantity of the respective material; and first and second means for respectively monitoring said core component and said tube component and for generating first and second signals in response to detection of the respective first sections, and means for evaluating said signals and for initiating adjustments of said at least one adjustable densifying means when the positions of detected first sections provided by said at least one adjustable densifying means depart from predetermined positions.

23. The apparatus of claim 22, wherein said evaluating means is operative to effect adjustments of the first sections provided by said at least one densifying means in a sense to at least reduce departures of positions of detected first sections from said predetermined positions.

24. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, at least one of said forming and building means including at least one densifying means for providing the respective component with alternating first and second sections respectively containing larger and smaller quantities of the respective material;

means for draping successive increments of the filler into a web of wrapping material in a second portion of said path downstream of said at least one first portion; and means for repeatedly severing the draped filler at said first sections to thus convert the draped filler into said series of articles each having a first end and a second end and at least one end of each article containing said larger quantity of the respective material, wherein said severing means is spaced apart and is disposed at a predetermined fixed distance from said at least one densifying means, said at least one densifying means including means for providing said first sections at a first frequency which is a function of the speed of lengthwise advancement of the core component along said path, said severing means comprising means for cutting across the draped filler at a second frequency in synchronism with said first frequency to thus ensure that each article comprises a first section at said at least one end thereof.

25. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, each of said forming and building means comprising at least one adjustable densifying means for providing the respective component with alternating first and second sections respectively containing larger and smaller quantities of the respective material;

means for draping successive increments of the filler into a web of wrapping material in a second portion of said path downstream of said at least one first portion;

means for repeatedly severing the draped filler at said first sections to thus convert the draped filler into said series of articles each having a first end and a second end and at least one end of each article containing said larger quantity of the respective material; and adjustable first signal generating sensor means for monitoring the core component in a third portion of said path upstream of said at least one first portion to ascertain the positions of first sections of said core component, second signal generating sensor means for monitoring said tube component to ascertain the positions of first portions of said tube component, and means for evaluating signals from said first and second sensor means and for adjusting said at least one adjustable densifying means when the monitored positions of first sections of said core component relative to the monitored positions of first sections of said tube component depart from predetermined values.

26. Apparatus for making a series of successive elongated rod-shaped smokable articles wherein longitudinally extending central core portions are surrounded by tube portions which, in turn, are surrounded by tubular wrapper portions, comprising:

means for forming a continuous elongated core component of a first material, including means for advancing the core component lengthwise in a predetermined direction along a predetermined path;

means for building a continuous elongated tube component of a second material around successive increments of the advancing core component in at least one first portion of said path to thus provide a composite elongated rod-shaped filler wherein the tube component surrounds the core component and which advances along said path, at least one of said forming and building means including at least one densifying means for providing the respective component with alternating first and second sections respectively containing larger and smaller quantities of the respective material, wherein said at least one densifying means forms part of said forming means;

means for draping successive increments of the filler into a web of wrapping material in a second portion of said path downstream of said at least one first portion; and means for repeatedly severing the draped filler at said first sections to thus convert the draped filler into said series of articles each having a first end and a second end and at least one end of each article containing said larger quantity of the respective material;

and a reservoir for a length of advancing core component between said forming means and said building means, said reservoir having an intake end nearer to and a discharge end remote from said forming means; and signal generating means for monitoring the density of successive increments of said core component and the positions of successive first sections of said core component relative to a fixed reference point.

27. The apparatus of claim 26, wherein said path includes a portion which is disposed between said intake and discharge ends of said reservoir and wherein the core component is free to sag under the action of gravity.

28. The apparatus of claim 27, wherein said advancing means is adjustable by a position monitoring device arranged to vary the speed of the core component as a function of changes of the extent of sag of said portion of the core component in said reservoir.

* * * * *